ROTARY NOTCHER AND FORMER

BACKGROUND OF THE INVENTION

1. Field of the Invention

This invention is particularly related to the production of collars and the like which are particularly used in heating and ventilating systems. In such systems, heated or cooled air is introduced into ducts, and pipes are connected to the ducts at various positions for directing the air to individual rooms or areas. To accomplish this, holes are formed in duct walls, and connectors including rectangular or circular collars are attached at these holes. Pipe sections are then attached to the connectors.

2. Description of the Prior Art

In a typical connector design, an edge of the connector is provided with a plurality of spaced apart notches. The hole in the duct wall is dimensioned to receive this edge, and the tabs which are formed between the notches are then bent outwardly whereby the connector can be secured relative to the duct wall. The opposite side of the connector may be crimped for purposes of facilitating the attachment of a pipe section to the connector.

Equipment for producing connectors of the type described is readily available. Thus, notched edges can be formed in various ways, and crimping rollers are also well known constructions. The notching and crimping steps are thus independently conducted, and the order of the steps is not critical.

SUMMARY OF THE INVENTION

In accordance with this invention, an apparatus is provided for achieving the notching of metal sheets in a highly efficient manner. Furthermore, the apparatus includes means whereby a crimping operation may be conducted automatically in conjunction with the notching. Finally, the invention contemplates the automatic production of cylindrical collars of any desired size whereby a flat sheet may be introduced to one end of the apparatus, and a cylindrical collar construction including the desired notching and crimping will exit from the apparatus.

The apparatus includes a rotary tool mounted on a shaft along with sheet advancing means for driving a sheet edge adjacent the rotary tool. The tool is characterized by a stabilizing structure whereby the tool operation is both accurate and efficient. The sheet advancing means serves to continuously expose unnotched sheet edge portions to the tool whereby the desired notches are automatically formed.

A crimping device, for example in the form of opposed crimping rollers, is removably mounted beyond the notching means. Deflecting means associated with the crimping device serve to turn the sheet into a circular configuration as the sheet exits from the crimping device. By selecting sheets of predetermined length and by positioning the deflecting means in a corresponding predetermined position, the apparatus of the invention will automatically produce cylindrical collars which are notched along one edge and which are also crimped. The apparatus thus provides a single machine for producing connectors in the manner described.

BRIEF DESCRIPTION OF THE DRAWINGS

FIG. 1 is a plan view of a sheet notching and crimping apparatus characterized by the features of this invention;

FIG. 2 is a side elevation of the notching and crimping apparatus;

FIG. 3 is an end view of the apparatus taken about the line 3—3 of FIG. 1;

FIG. 4 is an end view of the apparatus taken about the line 4—4 of FIG. 1;

FIG. 5 is a vertical, cross-sectional view taken about the line 5—5 of FIG. 2;

FIG. 6 is a vertical, cross-sectional view taken about the line 6—6 of FIG. 4;

FIG. 7 is a fragmentary, cross-sectional view taken about the line 7—7 of FIG. 1;

FIG. 8 is a fragmentary, cross-sectional view taken about the line 8—8 of FIG. 1;

FIG. 9 is an end view of a sheet formed in accordance with the practice of the invention; and, FIG. 10 is an end view of an alternative form of a sheet formed in accordance with the practice of the invention.

DESCRIPTION OF THE PREFERRED EMBODIMENT

The apparatus of the invention includes a drive pulley 10 mounted on shaft 12 for rotating gear 14 which meshes with gears 16 and 18. The gear 18 drives shaft 20 which supports worm 22, this worm in turn meshing with gear 24. The shaft 26 driven by gear 24 supports sheet drive roller 28. Idler roller 30 is supported on shaft 32 extending between side frames 34. These side frames are urged downwardly by springs 36 whereby the roller 30 is pressed into engagement with each sheet entering the apparatus.

A second pair of drive rollers 28 and 30 are provided, and a corresponding gear 24 meshing with worm 22 may be associated with these rolls. It will be appreciated that the described mechanisms for advancing sheets through the apparatus are conventional and do not form a part of the invention.

The drive gear 16 is mounted on shaft 38 which extends between transverse frame members 40 and 42. This shaft is also supported by bearings of intermediate frame member 44, and the shaft is provided for supporting rotary tool 46.

The tool 46 includes rotary blade 48 and an associated fitting 50. This fitting is secured to the blade by means of bolts 52 and a retaining ring 54 secures the assembly of the fitting and blade against axial movement along shaft 38. A compression spring 56 extends around shaft 38. One end of the spring bears against blade 48, and the other end of the spring bears against washer 58 positioned adjacent intermediate frame member 44. Since the frame member 44 comprises a fixed portion of the apparatus, the spring 56 constantly presses against the blade 48. A rotary thrust bearing 60 is associated with the shaft 38 in the area of frame 40. Accordingly, forces exerted by the spring 56 are applied to this thrust bearing. A standard locking ring 62 secures the shaft 38 against displacement inwardly against the action of spring 56.

A supporting table 63 of conventional design may be utilized for sheet 64 fed to the apparatus. The inner edge of the sheet may bear against wall 34 or a suitable gauge

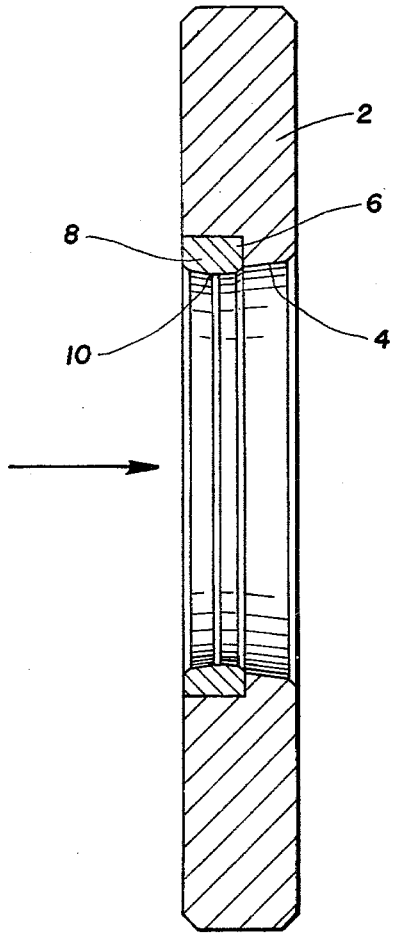
2
6
8
10
4

DIE ASSEMBLY AND METHOD OF MAKING THE SAME

This invention which is a continuation-in-part of my co-pending application, Serial No. 808,220, filed June 20, 1977, now U.S. Pat. No. 4,145,910.

The invention relates to a die assembly and to a method of making the same and particularly to a draw or ironing die assembly used in the manufacture of cans from tin plate (steel coated with tin). It may also be used in other types of dies including heading and extrusion dies for use with various types of material in addition to steel can bodies. The dies most commonly used have a precision ground steel body with a counterbored axial hole therethrough. The working surface of the die is provided by a canbide insert which is shrunk fit into the counterbore. In making the skrink fit the die body becomes deformed to such an extent that it is more expensive to repair the body and replace it with a new insert when the old one must be replaced than to make a new die body and put in a new insert. Thus no part of the die is reused.

In my co-pending application I use a three part die assembly which results in very substantial savings in that the housing and intermediate insert may be reused with only the die wear ring being replaced. This, however, does not increase the life of the die wear ring.

I have also found that a standard die having a steel housing or body and a tungsten carbide insert or die wear ring expands from 0.0006 to 0.0008 inch when ironing. This starts microscopic cracks on the surface of the land and entrance angle of the wear ring, thus decreasing its life.

I have found that by substituting a cemented or sintered tungsten carbide die case or housing having a much higher modulus of elasticity than a steel housing this expansion is eliminated or greatly reduced with resultant much greater life of the wear ring. The deformation of the die housing is also eliminated or greatly reduced so that it can be reused.

This solid cemented carbide housing also allows the use of a very hard, extremely low binder (such as 1½% by weight of cobalt) material in the die insert. The die insert can also be made of very brittle material.

It is therefore an object of my invention to provide a die assembly which permits reuse of the die housing while replacing only the die wear ring.

Another object is to provide such a die assembly which results in several times greater longer life of the die wear ring and virtually eliminates die expansion during the ironing operation.

A further object is to provide such a die which has lower tool maintenance and replacement costs, and results in less downtime than previous dies.

A still further object is to provide such a die which results in better surface conditions of the can or other workpiece.

Still another object is to provide a die which results in a product, suchb as a can, having decreased wall thickness variation and greater overall accuracy.

Still another object is to provide a method of making such a die.

These and other objects will be more apparent after referring to the following specification and attached drawings in which the single FIGURE is a sectional view of the die of my invention.

Referring more particularly to the drawing, reference numeral 2 indicates the die housing or body of my invention. The die body 2 has a counterbored axial hole 4 therethrough. It will be seen that the bottom of the counterbore forms a shoulder 6. An insert or wear ring 8 is received in the counterbore against the shoulder 6. It will be seen that the outer diameter of insert 8 is greater than the inner diameter of the counterbore. The inner surface 10 of insert 8 extends beyond the shoulder 6 and forms the die working surface.

According to my invention the body 2 is made of a material having a minimum modulus of elasticity of approximately 50,000,000 pounds per sq. in. with the die wear ring 8 having a higher modulus of elasticity which preferably approaches that of the body 2. However, it is preferred that the modulus of elasticity of the body 2 be at least approximately 80,000,000 p.s.i. In no case should the modulus of elasticity of the housing 2 be less than ½ that of the die ring 8. For example, the body 2 may be made of tungsten carbide and the die wear ring 8 also of tungsten carbide having a higher modulus of elasticity and greater hardness than the housing. I have found that cemented tungsten carbide having 10% cobalt, $R_A$ 88 to 90 hardness, a density of 14.2 to 14.6 grams per cubic centimeter, an elastic modulus of 86 to $88\times10^6$ lbs. per square inch and a porosity of A-2, B-1, C-1 is very suitable for the body 2 and that cemented tungsten carbide having approximately 98.5% tungsten carbide and approximately 1.5% cobalt, $R_A$ $93.2\pm3$ hardness, density of $15.55\pm0.1$ grams per cc., an elastic modulus of $108\times10^6$ lbs. per square inch and a porosity of A-0, B-0, C-0 is highly suitable for the wear ring 8. All percentages are by weight.

Other materials which are particularly suitable for the housing 2 include various metal carbides such as cemented tungsten carbide with a nickel or metal alloy binder in place of the cobalt binder, and cemented titanium carbide with a nickel, cobalt, molybdenum or a metal alloy binder.

Other materials which are particularly suitable for the wear ring 8 include various metal carbides such as cemented titanium carbide, cemented molybdenum carbide, ceramic materials such as zirconium oxide and aluminum oxide ($Al_2O_3$) and cements such as hot pressed $Al_2O_3$ and TiC mixtures as well as other metal oxide-metal carbide combinations.

The radial wall thickness of the housing 2 is not critical and may vary greatly depending upon the material being drawn, the amount of reduction and the other factors commonly considered by the routine designer. In general the thinner the wall thickness of the wear ring 8, the thicker will be the wall thickness of the housing 2. Some typical die assemblies using carbide housings and wear rings are as follows:

A housing 2 having an outside diameter of 6.000 in., and 2.680 in. and 3.000 in. diameters of the counterbored hole 4 and a wear ring 8 having an outside diameter of 3.000 in. and an inside diameter which may vary, but which is less than 2.680 in.

A housing 2 having an outside diameter of 4.500 in., and 2.680 in. and 3.000 in. diameters of the counterbored hole 4 and a wear ring 8 having an outside diameter of 3.000 in. and an inside diameter which may vary, but which is less than 2.680 in.

A housing 2 having an outside diameter of 4.250 in., and 2.680 in. and 3.000 in. diameters of the counterbored hole 4 and a wear ring having an outside diameter which may vary from 2.900 to 3.000 in. with the larger diameter of the counterbore corresponding thereto.

In making the die, the wear ring 8 is shrunk fit into the body 2 with an interference fit of 0.0007±0.0001 inch. When the wear ring has been ground through its range of sizes it is pressed out and a new one installed by heating only to about 300° F. At this temperature the body 2 retains its flatness and roundness.

While one embodiment has been shown and described in detail, it will be readily apparent to those skilled in the art that various adaptations and modifications may be made within the scope of the invention.

I claim:

1. A drawing and ironing die assembly comprising a housing having an axial hole therethrough, and a radial shoulder on the exit side of said housing, provided by means of a counterbore on the entry side of said axial hole, and a die wear ring in said axial hole bearing against said shoulder having a shrink fit with said housing with an interference fit of from 0.0006 to 0.0008 inch, said housing made of a material having a minimum modulus of elasticity of approximately 50,000,000 pounds per square inch, and said wear ring having a higher modulus of elasticity than said housing, and an outer diameter of the wear ring greater than an inner diameter of the counterbore.

2. A die assembly according to claim 1 in which said housing and die wear ring are made of metal carbides.

3. A die assembly according to claim 1 in which the housing has a minimum modulus of elasticity of 80,000,000 pounds per sq. in.

4. A method of making a drawing and ironing die assembly which comprises providing a housing having a minimum modulus of elasticity of approximately 50,000,000 pounds per square inch, having an axial hole therethrough, and a counterbore on the entry side of said axial hole providing a radial shoulder, providing a die wear ring of a material having a higher modulus of elasticity and greater hardness than said housing and having an outside diameter only slightly greater than the diameter of said axial hole, and shrink fitting said wear ring into said axial hole with an interference fit of from 0.0006 to 0.0008 inch.

5. The method of making a die assembly according to claim 4 in which said body is heated to a temperature of approximately 300° F. during said shrink fit.

* * * * *